US011648648B2

(12) United States Patent
Kelly, Jr.

(10) Patent No.: US 11,648,648 B2
(45) Date of Patent: May 16, 2023

(54) CONCRETE PRESSURE WRENCH

(71) Applicant: George M. Kelly, Jr., Dorchester, MA (US)

(72) Inventor: George M. Kelly, Jr., Dorchester, MA (US)

( * ) Notice: Subject to any disclaimer, the term of this patent is extended or adjusted under 35 U.S.C. 154(b) by 0 days.

(21) Appl. No.: 17/219,164

(22) Filed: Mar. 31, 2021

(65) Prior Publication Data

US 2022/0314404 A1 Oct. 6, 2022

(51) Int. Cl.
*B25B 13/50* (2006.01)
*B25B 27/02* (2006.01)

(52) U.S. Cl.
CPC ..... *B25B 13/5041* (2013.01); *B25B 27/02* (2013.01)

(58) Field of Classification Search
CPC ..... B25B 13/5041; B25B 27/02; B25B 23/16; B25B 23/005; B25G 1/007; B25G 1/005
USPC ..... 81/180, 177.1, 185.2, 180.1, 177.2
See application file for complete search history.

(56) References Cited

U.S. PATENT DOCUMENTS 732,858 A * 7/1903 Irland ..... B25B 13/28 81/177.2
1,393,830 A * 10/1921 Rosenfeld ..... B21D 7/063 72/458
2,725,773 A * 12/1955 Anacker ..... B25G 1/005 81/177.2
2,780,121 A * 2/1957 White ..... B21D 7/063 72/458
5,678,804 A * 10/1997 Lintelman ..... B66F 15/00 254/133 R
6,199,456 B1 * 3/2001 Hlady ..... B25G 1/043 81/177.2
7,762,529 B1 * 7/2010 Scott ..... B60D 1/06 280/441.2

* cited by examiner

*Primary Examiner* — Hadi Shakeri
*Assistant Examiner* — Tyler James McFarland
(74) *Attorney, Agent, or Firm* — Lando & Anastasi, LLP

(57) ABSTRACT

A wrench for opening and closing a clamp having a lever includes a handle section, a leverage section, and a locking assembly. The leverage section is coupled to the handle section. The leverage section includes an engagement surface to engage the clamp and an opening formed therein, the opening being configured to receive the lever of the clamp therein. The locking assembly is coupled to the leverage section. The locking assembly is configured to releasably secure the leverage section to the lever of the clamp when the lever is received within the opening of the leverage section.

6 Claims, 8 Drawing Sheets

CONCRETE PRESSURE WRENCH

BACKGROUND OF DISCLOSURE

The present disclosure relates to a wrench for opening and closing a clamp, such as a clamp used to join sections of pipe in a concrete dispensing system.

A typical concrete dispensing system includes a concrete mixer and one or more pipes that direct concrete from the concrete mixer to a site where the concrete is to be placed. On large construction sites, a plurality of pipes are joined together to direct concrete from the concrete mixer to the site where the concrete is to be placed. At a joint between the two pipes, a clamp is used to secure a first pipe to a second pipe.

FIG. 1 shows an exemplary embodiment of a clamp, generally indicated at 10, that is used to join two sections of pipe for delivering concrete to a site. The clamp 10 includes a first clamshell portion 12 and a second clamshell portion 14 that are joined at a first pin 16 and are capable of being tightened together around the joint of a first pipe and a second pipe. In some embodiments of the clamp 10, the first clamshell portion 12 and the second clamshell portion 14 can be biased to a closed position, such as by a spring bias. The clamp 10 includes a lever 18 that can be rotated about a second pin 20. The lever 18 can be manipulated to rotate the second clamshell portion 14 towards the first clamshell portion. Clockwise rotation of the lever 18 about the pin 20, indicated by arrow A in FIG. 1, fastens the first clamshell portion 12 and the second clamshell portion 14 of the clamp 10 onto the first pipe and the second pipe at the joint of the two pipes. Counterclockwise rotation of the lever 18 about the pin 20, in a direction opposite arrow A in FIG. 1, loosens the first clamshell portion 12 and the second clamshell portion 14 of the clamp 10 with respect to the pipes so the joint of the first pipe and the second pipe may be disconnected.

Typically, opening and closing of such a clamp having a five-inch diameter requires two or three people to rotate the lever with a tool because the people must overcome a spring force when opening the clamp 10 and when closing the clamp 10.

SUMMARY OF DISCLOSURE

One aspect of the disclosure is directed to a wrench for opening and closing a clamp having a lever. The wrench comprises a handle section, a leverage section, and a locking assembly. The leverage section is coupled to the handle section. The leverage section includes an engagement surface to engage the clamp and an opening formed therein. The opening is configured to receive the lever of the clamp therein. The locking assembly is coupled to the leverage section. The locking assembly is configured to releasably secure the leverage section to the lever of the clamp when the lever is received within the opening of the leverage section.

In some embodiments, the handle section includes an upper portion and a lower portion. In some embodiments, the leverage section includes an upper portion secured to the upper portion of the handle section and a lower portion secured to the lower portion of the handle section, the lower portion of the leverage section having the opening that is configured to receive the lever of the clamp. In various embodiments, the lower portion of the leverage section is curved. In various embodiments, the wrench further comprises a strut having a first end and a second end each secured to the curved lower portion of the leverage section.

In various embodiments, the locking means includes a threaded bolt that extends through a threaded hole in a wall of the lower portion of the leverage section so that an end of the threaded bolt is configured to secure the lever between the threaded bolt and an inner surface of the leverage section. In various embodiments, the wrench further comprises a platform extending laterally from an outer surface of the leverage section. In various embodiments, the handle section is linear.

In some embodiments, the handle section includes an upper portion and a lower portion; the leverage section includes an upper portion secured to the upper portion of the handle section and a lower portion secured to the lower portion of the handle section, the lower portion of the leverage section having the opening that is configured to receive the lever of the clamp; and the lower portion of the leverage section is curved. In various embodiments, the handle section is linear. In various embodiments, the wrench further comprises a platform extending laterally from an outer surface of the leverage section.

In some embodiments, the handle section and the leverage section are welded together.

In some embodiments, the handle section is substantially tubular and the leverage section is substantially tubular. In various embodiments, the upper portion of the leverage section is nested in the upper portion of the handle section.

In some embodiments, the wrench further comprises two arms extending from the lower portion of the handle section, wherein the two arms are welded to the lower portion of the second member.

In some embodiments, the locking assembly includes a threaded bolt that extends through a threaded hole in a wall of the leverage section so that an end of the threaded bolt is configured to secure the lever between the threaded bolt and an inner surface of the leverage section.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
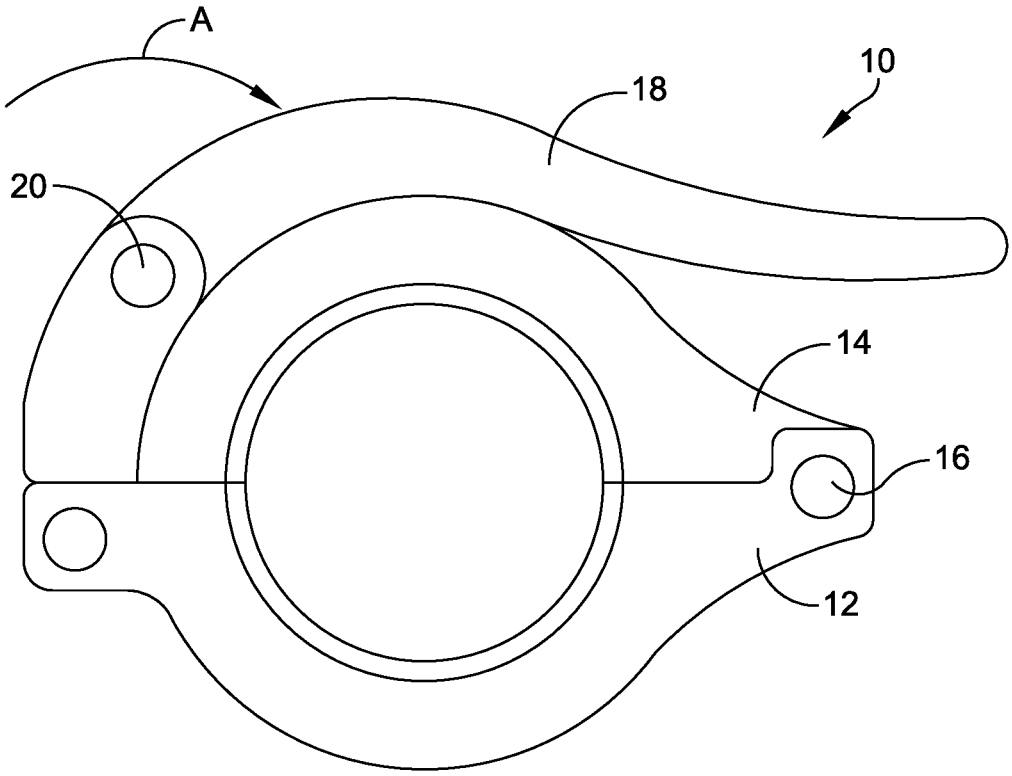
FIG. 1 is a schematic side view of a prior art clamp for joining pipes in a concrete dispensing system.

This disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The present disclosure provides a wrench configured for opening and closing a clamp that is used to join two pipes in the concrete dispensing system, such as the clamp 10 of FIG. 1. The wrench is designed to engage the lever of the clamp so that manual rotation of the wrench results in rotation of the lever of the clamp. The wrench includes a curved portion to receive the lever of the clamp, a handle to apply leverage, and a lock to ensure that the wrench does not slip off of the lever when leverage is applied to the handle.

Embodiments of the wrench of the present disclosure may be operated by a single user to open and close the clamp. For example, embodiments of the wrench of the present disclosure can be used by a single person to open or close the clamp to connect or disconnect pipe joints in the concrete dispensing system.

Embodiments of the wrench of the present disclosure can increase the efficiency of installation and removal of clamps by between 40% and 60%, in terms of the amount of time needed to open and close the clamps.

Embodiments of the wrench of the present disclosure limit or prevent bodily injury during operation of a five-inch diameter clamp in a commercial liquified concrete dispensing system. The safety factor is improved because the user's hands are not near the lever of the clamp, such as clamp 10 of FIG. 1, so the user's fingers are less likely to be pinched. In some embodiments, the user can apply foot pressure to the wrench to close the clamp.

In some embodiments, the wrench is configured to be secured to the lever of the clamp when the wrench is in use so the wrench will not slip off of the lever of the clamp. The user slides the wrench onto the lever and then locks the wrench onto the lever during usage.

In some embodiments, the wrench is at least partially hollow. In some embodiments, the wrench is made of tubing. In some embodiments, the wrench is made of electrical metal tubing. In some embodiments, the tubing is welded together for reinforcement. Hollow embodiments of the wrench of the present disclosure are lighter and easier for a user to manipulate.

Referring now to FIGS. 2-5, an embodiment of a wrench, generally indicated at 30, is configured for use in opening and closing clamps that have levers that are used to join pipes to deliver mixed concrete in the concrete dispensing system. In some embodiments, wrench 30 is configured for opening and closing clamp 10.

The wrench 30 has an upper end 32 and a lower end 34. The lower end 34 of the wrench 30 is configured to engage the lever 18 on the clamp 10 (FIG. 1), and the upper end 32 of the wrench 30 is configured to be gripped by a user so the user can rotate the upper end 32 relative to the lower end 34 about a pivot point 36 of the wrench 30 so the lower end 34 rotates the lever 18 of the clamp 10.

The wrench 30 includes a first member, generally indicated at 40, sometimes referred to as a handle section, and a second member, generally indicated at 42, sometimes referred to as a leverage section, that are secured together. In some embodiments, the first member and the second member are integrally formed with one another to create a unitary member. In some embodiments, the first member 40 and the second member 42 are secured together by welds. In some embodiments, the first member 40 and the second member 42 are secured together in another way, such as by threaded fasteners, clamps, or other fastening means.

In some embodiments, the first member 40 and the second member 42 are formed as a single piece. In some embodiments, the single piece is at least partially hollow. In some embodiments, the single piece is substantially hollow.

Figure 6:
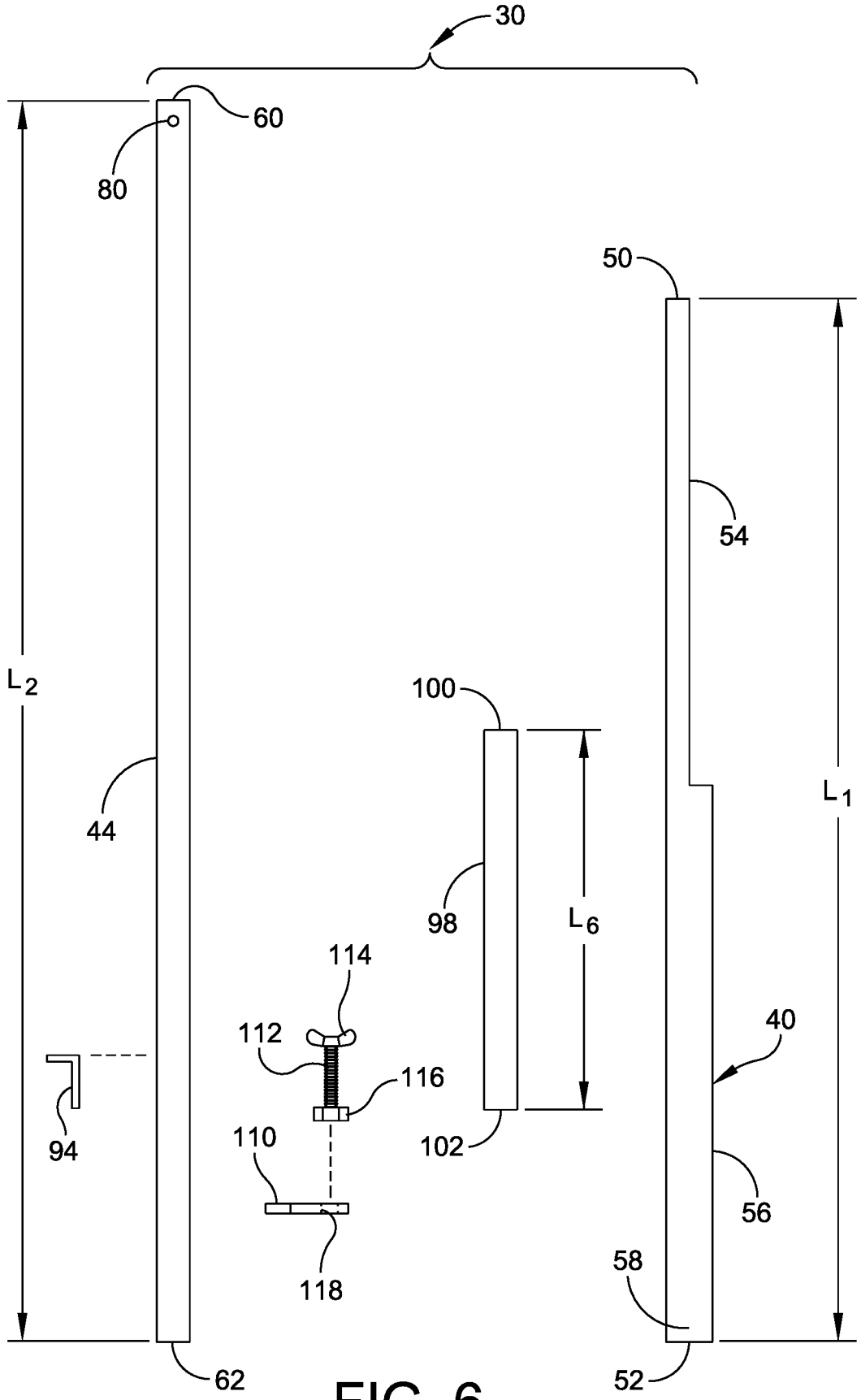
FIG. 6 is a plan view of disassembled components of the wrench of FIG. 2.

The wrench 30 may be assembled from the component parts shown in FIG. 6. A partially assembled perspective view of the wrench is shown in FIG. 7.

Figure 7:
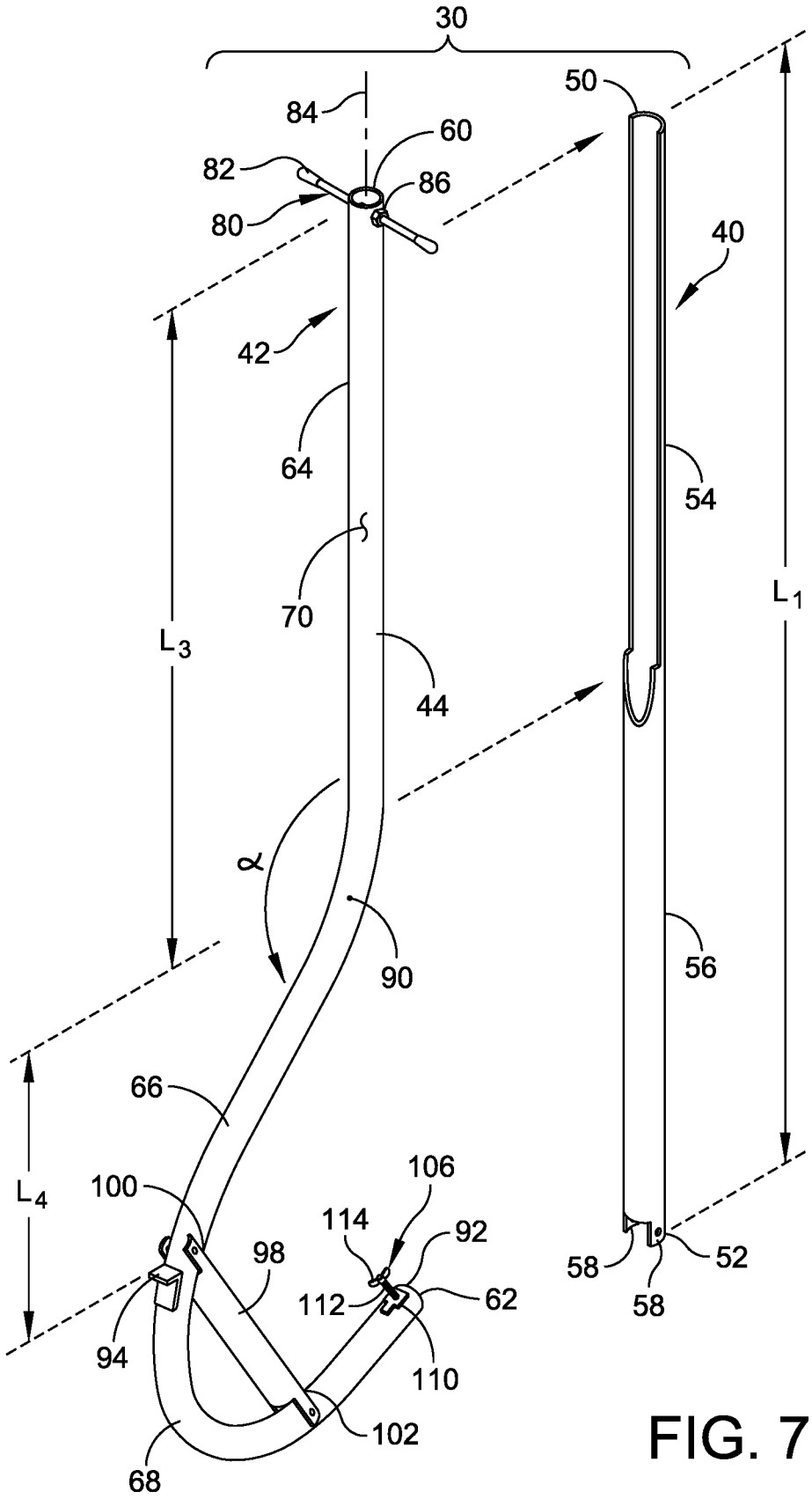
FIG. 7 is a perspective view of the components of the wrench of FIG. 2 partially assembled.

Referring to FIG. 7, in the embodiment of the wrench 30, the first member 40 extends linearly from a first end 50 of the first member 40 to a second end 52 of the first member 40. The first member 40 includes an upper portion 54 and a lower portion 56.

With reference to FIGS. 6 and 7, the first member 40 of the wrench 30 can be seen disassembled from the second member 42 (FIG. 7) of the wrench 30. The upper portion 54 of the first member 40 is a half-pipe portion near the first end 50 of the first member 40. The upper portion 54 of the first member 40 has a semicircular cross-section. The upper portion 54 is configured to receive a portion of the second member 42 so the second member 42 is at least partially nested within the upper portion 54 of the first member 40.

The lower portion 56 of the first member 40 is tubular and is configured to be near the second end 52 of the first member 40. Because the lower portion 56 of the first member 40 is tubular, the lower portion 56 of the first member 40 has increased rigidity relative to the upper portion 54 of the first member 40.

The second end 52 of the first member 40 includes two arms, each indicated at 58, that are configured to extend over a portion of the second member 42 near the pivot point 36 of the wrench 30 to stabilize the second end 52 of the first member 40 with respect to the second member 42. The two arms 58 extend longitudinally so that the second member 42 can be received between the two arms 58 and secured to the two arms 58. In some embodiments, the arms 58 are configured to be secured to the second member 42 by one or more welds.

Figure 2:
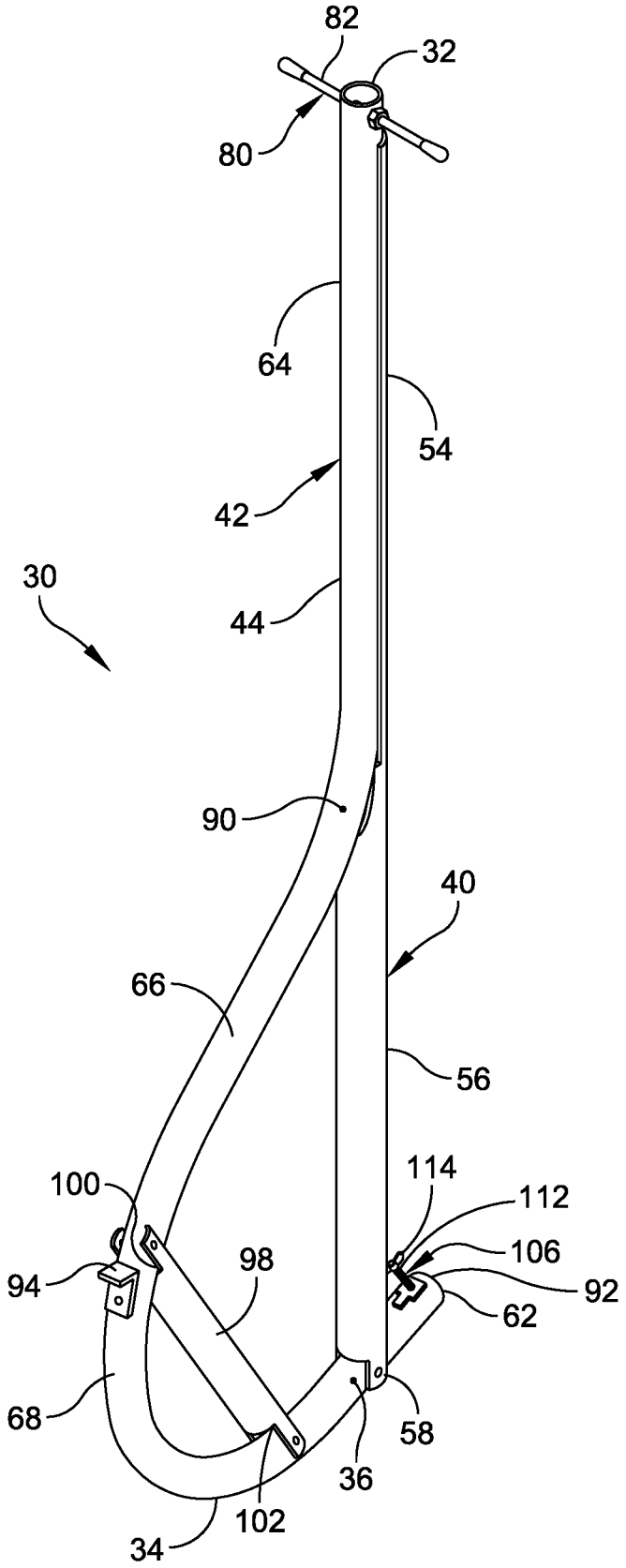
FIG. 2 is a perspective view of an exemplary embodiment of a wrench according to the present disclosure.

In some embodiments, the first member 40 is made from metal tubing. In some embodiments, the first member 40 is made of electrical metal tubing. In the embodiment of FIG. 2, the first member 40 is made from electrical metal tubing having a diameter of 1.25 inches and a length $L_1$ of 44.25 inches.

The second member 42 is configured to be secured to the first member 40. The components of the disassembled wrench 30 are shown in the plan view of FIG. 6, and various components of the wrench are assembled to form the second member 42 as shown in FIG. 7 prior to securing the second member 42 to the first member 40.

The second member 42 includes a tubular member 44 having a first end 60 and a second end 62. The first end 60 of the tubular member 44 of the second member 42 is configured to be gripped by a user. The second end 62 is configured to receive the lever 18 of the clamp 10 (FIG. 1) and to be secured to the lever 18 of the clamp 10, as described in more detail below.

In some embodiments, the tubular member 44 of the second member 42 is made from metal tubing. In some embodiments, the tubular member 44 of the second member 42 is made of electrical metal tubing. As shown in FIG. 6, the tubular member 44 is formed from a linear section of electrical metal tubing having a diameter of 1 inch and a length $L_2$ of 61.5 inches.

The linear section of electrical metal tubing is subsequently bent before assembling the second member 42 shown in FIG. 7. As shown in FIG. 7, the tubular member 44 of the second member 42 includes a linear upper portion 64, a middle portion 66, and a curved lower portion 68.

The upper portion 64 of the tubular member 44 is a linearly extending portion of the tubular member 44. The upper portion 64 of the tubular member 44 has an outer surface 70 that is configured to be received in the half-pipe upper portion 54 of the first member 40. The upper portion 64 of the tubular member 44 may be secured to the upper portion 54 of the first member 40, such as by one or more welds.

A handle, generally indicated at 80, is secured to the upper portion 64 of the tubular member 44 and located near the first end 60 of the tubular member 44. The handle 80 includes a bar 82 that extends transversely with respect to a longitudinal axis 84 of the upper portion 64 of the second member 42. A user may grip the handle 80 to rotate the second member 42 about an axis perpendicular to the longitudinal axis 84 of the upper portion 64 of the tubular member 44.

In the exemplary embodiment, the bar 82 of the handle 80 is a threaded rod that is received in holes defined in the upper portion 64 of the tubular member 44 near the first end 60 of the tubular member 44. The threaded rod is secured to the tubular member 44 of the second member 42 by two threaded nuts 86. In some embodiments, the nuts are 6.375 inch nuts.

In some embodiments, a gripping surface extends over the bar 82. In some embodiments, the gripping surface is an ergonomic gripping surface.

The middle portion 66 of the tubular member 44 is a substantially linear portion that joins the upper portion 64 to the lower portion 68 of the tubular member 44 of the second member 42.

Figure 3:
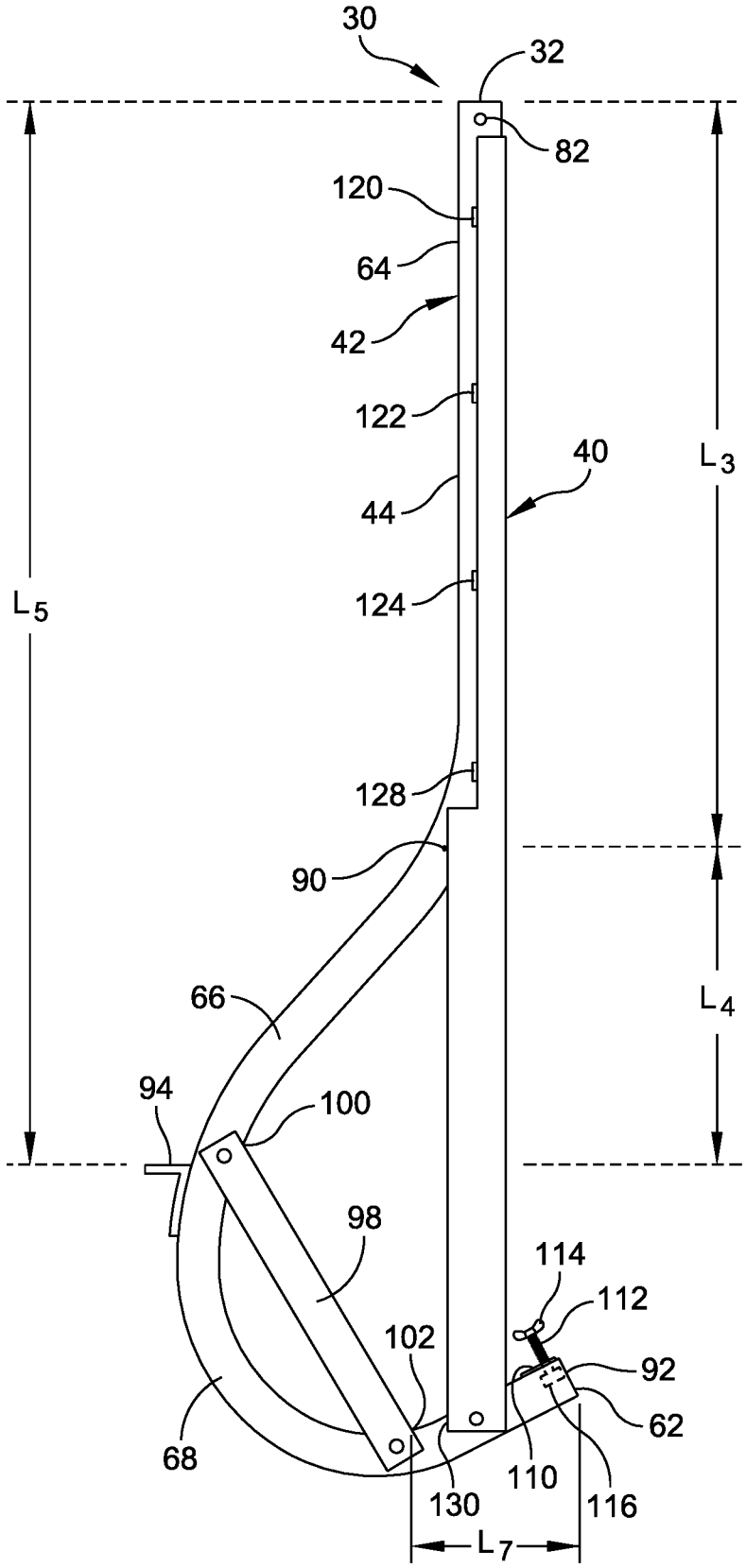
FIG. 3 is a side view of the wrench of FIG. 2.
Figure 4:
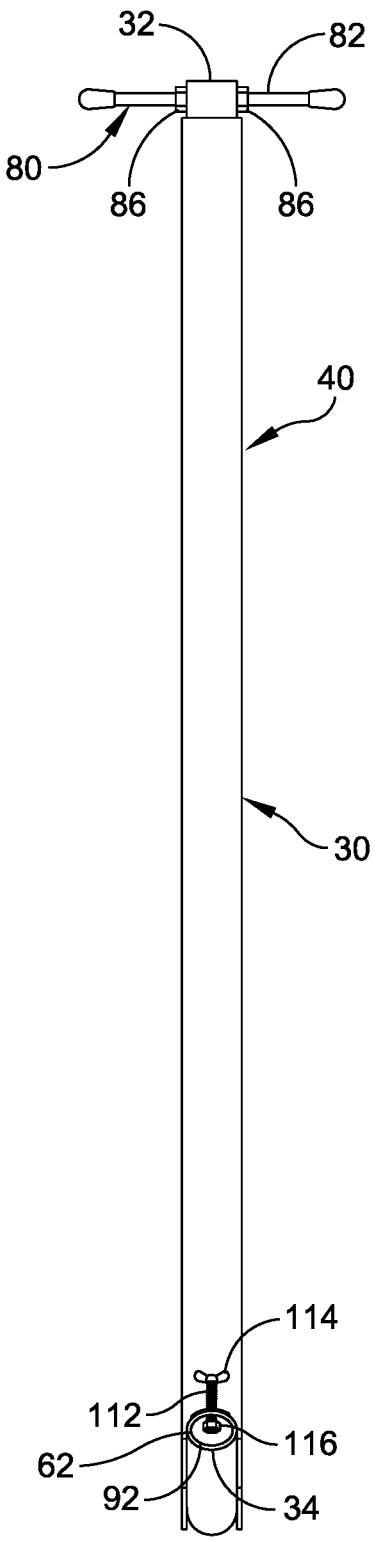
FIG. 4 is a front view of the wrench of FIG. 2.
Figure 5:
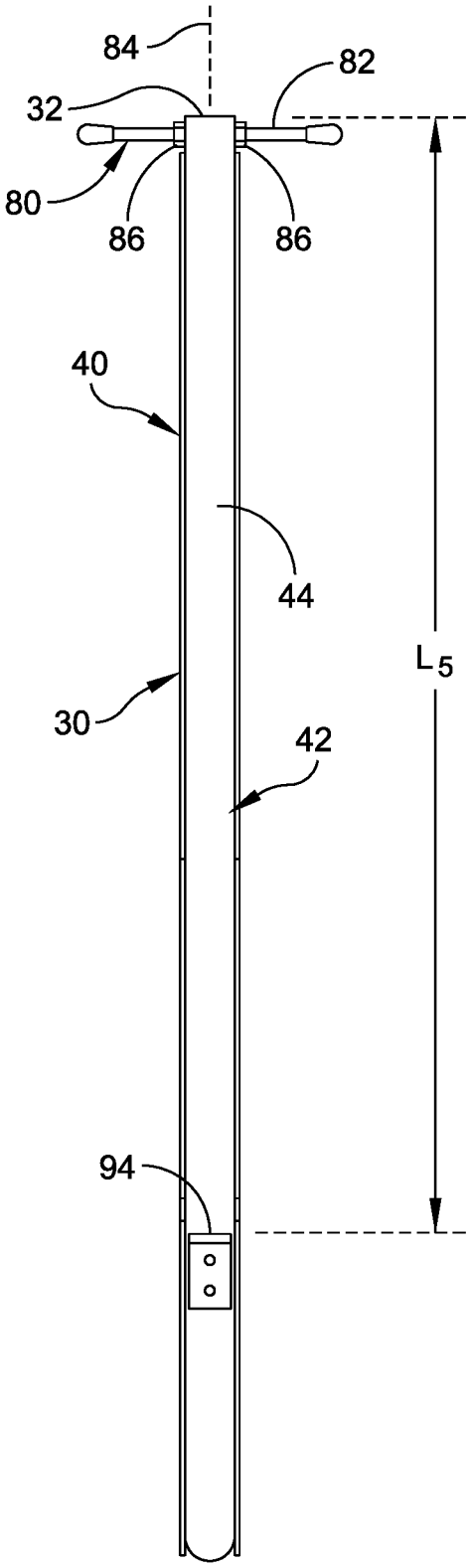
FIG. 5 is a back view of the wrench of FIG. 2.

As shown in FIG. 7, the middle portion 66 of the tubular member 44 meets the upper portion 64 of the tubular member 44 at a bend 90 in the tubular member 44. Referring momentarily back to FIG. 3, the bend 90 is located a distance $L_3$ of 23 inches below the upper end 32 of the wrench 30. The bend 90 in the tubular member 44 is in a first direction. In some embodiments, the bend 90 has an angle $\alpha$ in the range of 45 degrees to 75 degrees. In some embodiments, the angle $\alpha$ is in the range of 55 degrees to 65 degrees. In some embodiments, the angle $\alpha$ is about 60 degrees.

The lower portion 68 of the tubular member 44 is curved in a second direction that is opposite to the direction of the bend 90 between the upper portion 64 and the middle portion 66 of the tubular member 44. In some embodiments, the lower portion 68 includes a segment that has a diameter of curvature of 13 inches and a central angle of 160 degrees. The curved lower portion 68 terminates at the second end 62 of the tubular member 44 so the lever 18 of the clamp 10 can be easily aligned with and received in an opening 92 of the tubular second end 62 of the tubular member 44, as described in more detail below.

As shown in FIGS. 6 and 7, a platform 94 is secured to an outer surface of the lower portion 68 of the second member 42, and is provided to add additional leverage to the wrench 30 when closing the clamshell portions 12, 14 of the clamp 10. The platform 94 is located at a distance $L_4$ of 15 inches below the bend 90 in the tubular member 44. Referring momentarily back to FIG. 3 and to FIG. 5, the platform 94 is located a distance $L_5$ of 38 inches below the upper end 32 of the wrench 30. As shown in FIG. 7, the platform 94 extends laterally from an outer surface of the lower portion 68 of the tubular member 44. For some clamps, such as clamp 10, the spring force of the lever 18 of the clamp 10 is sufficiently high that the user needs an additional mechanical advantage to rotate the lever 18 of the clamp 10. For such clamps, a user can place one of their feet on an upper surface of the platform 94. Application of the user's weight to the upper surface of the platform 94 via the user's foot facilitates rotation of the wrench 30 about the pivot point 36 of the wrench 30.

In some embodiments, the platform 94 has dimensions of 3.5 inches by 1.5 inches by 0.375 inches.

The second member 42 of the wrench 30 further includes a strut 98 that reinforces the curved lower portion 68 of the tubular member 44. The strut 98 improves the rigidity of the curved lower portion 68 so that the curved lower portion 68 can withstand the forces necessary to rotate the lever 18 to open or close the clamp 10, such as when a user applies their weight to the platform 94. As shown in FIG. 6, the strut 98 has a length $L_6$ of 14 inches.

As shown in FIG. 7, when the strut 98 is secured to the lower portion 68 of the tubular member 44, the strut 98 spans an arc length of the curved lower portion 68 of the tubular member 44. As shown in FIG. 3, a first end 100 of the strut 98 is secured to the lower portion 68 and is located at the height of the platform 94. Referring momentarily back to FIG. 3, a second end 102 of the strut 98 is secured to the lower portion 68 and is located a distance $L_7$ of 6 inches from the front end of the wrench 30.

The strut 98 may be a tubular member. In some embodiments, the strut 98 is a piece of metal tubing. In some embodiments, the strut 98 is a piece of electrical metal tubing. In the embodiment of FIG. 6, the strut 98 is made from electrical metal tubing having a diameter of 1.25 inches.

The strut 98 is configured to be secured to the lower portion 68 of the tubular member 44. In some embodiments, the first end 100 of the strut 98 and the second end 102 of the strut 98 are welded to the lower portion 68 of the tubular member 44.

A locking means, generally indicated at 106 in FIG. 2, is secured to the tubular member 44. In some embodiments, the locking means 106 is configured to capture the lever 18 of the clamp 10 to prevent removal of the lever 18 of the clamp 10 (FIG. 1) from the wrench 30. The locking means 106 is configured to secure the lever 18 of the clamp 10 within the second end 62 of the tubular member. In some embodiments, when the second member 42 is assembled, the locking means 106 is configured to secure the lever 18 of the clamp 10 within the opening 92 of the curved lower portion 68 of the tubular member 44.

In some embodiments, the locking means 106 is a locking assembly. The locking assembly has a reinforcing plate 110 (FIG. 6) configured to be secured to the tubular member 44, a threaded bolt 112, a wingnut 114 at one end of the bolt 112 for turning the bolt 112, and a position limiting nut 116 secured to an opposite end of the bolt 112.

When the locking means 106 is secured to the tubular member 44 as shown in FIG. 7, the reinforcing plate 110 is secured to an upper surface of the lower portion 68 of the tubular member 44 and the threaded bolt 112 is received by the reinforcing plate 110 and the lower portion 68 of the tubular member 44. The threaded bolt 112 extends through a threaded hole 108 in the wall of the lower portion 68 of the tubular member 44 so that position limiting nut 116 at the second end of the threaded bolt 112 secures the lever 18 between the position limiting nut 116 and an inner surface of the second member 42.

The reinforcing plate 110 is configured to be secured to the lower portion 68 of the tubular member 44. In particular, the reinforcing plate 110 has a curved lower surface configured to be secured to a curved upper surface of the lower portion 68 of the tubular member 44. In some embodiments, the reinforcing plate 110 is welded to the upper surface of the lower portion 68 of the tubular member.

In some embodiments, the reinforcing plate 110 of FIG. 6 has dimensions of 1.875 inches by 4.5 inches.

As shown in FIG. 7, the reinforcing plate 110 extends partially over a surface of the lower portion 68 of the tubular member 44 at the second end 62 of the tubular member 44 to help the tubular member 44 resist deformation due to rotational forces when the opening 92 of the tubular member 44 engages the lever 18 of the clamp 10 to rotate the lever 18. The reinforcing plate 110 includes a threaded hole 118 aligned with the threaded hole defined in the lower portion 68 of the tubular member 44.

The threaded bolt 112 is received in the threaded hole 118 in the reinforcing plate 110 and the threaded hole 108 in the second member 42. A first end of the threaded bolt 112 is configured to engage the lever 18 received in the second member 42 and a second end of the threaded bolt 112 is configured to be rotated by a user to tighten or loosen the threaded bolt 112. To secure the lever 18 within the second end 62 of the tubular member 44, a user inserts the lever 18 into the opening 92 in the second end 62 of the tubular member 44 and tightens the threaded bolt 112 so the lever 18 is firmly secured between the first end of the threaded bolt 112 and an inner surface of the second member 42. To release the lever 18 from the second member 42, the user loosens the threaded bolt 112 and slides the lever 18 out of the opening 92 at the second end 62 of the tubular member 44.

In some embodiments, the threaded bolt 112 is automatically adjusting. In some embodiments, the wrench 30 includes a control system and an actuator to automatically adjust the threaded bolt 112 to be tightened on or loosened from the lever 18 of the clamp 10.

When the lever 18 is secured within the opening 92 of the tubular member 44, a user can rotate the wrench 30 about the pivot point 36 of the wrench 30 to rotate the lever 18 of the clamp 10. The user grips the handle 80 and rotates the wrench 30 about the pivot point 36.

In some embodiments, the threaded bolt 112 has a length of 4 inches and a diameter of 0.375 inches.

In some embodiments, the wingnut 114 is welded to the threaded bolt 112.

In some embodiments, the position limiting nut 116 ensures that the wrench 30 does not slip off of the lever 18 of the clamp 10.

The position limiting nut 116 is secured to the first end of the threaded bolt 112. In some embodiments, the position limiting nut 116 is secured to the first end of the threaded bolt 112 by a weld.

In some embodiments, the position limiting nut 116 is a nut measuring 1 inch by 0.375 inches.

Once the components of FIG. 6 are assembled to form the first member 40 and the second member 42 shown in FIG. 7, the first member 40 and the second member 42 are secured together to form the wrench 30.

The upper portion 64 of the tubular member 44 is longitudinally aligned with the upper portion 54 of the first member 40 so the convex outer surface of the upper portion 64 of the tubular member 44 is nested in the concave inner surface of the half-pipe upper portion 54 of the first member 40. The lower portion 68 of the tubular member 44 near the second end 62 of the tubular member 44 is slid between the arms 58 located at the second end 52 of the first member 40.

As shown in FIG. 3, the upper portion 54 of the first member 40 and the upper portion 64 of the tubular member 44 are welded together at three spaced apart locations 120, 122, 124. In some embodiments, the welds 120, 122, 124 at each spaced apart location is one inch in length. Another weld 128 is formed between the first member 40 and the tubular member 44 of the second member 42 at the bend 90 in the tubular member 44 of the second member 42. Two more welds 130 are formed between the lower portion 68 of the tubular member 44 of the second member 42 and the two arms 58 of the first member 40.

Figure 8A:
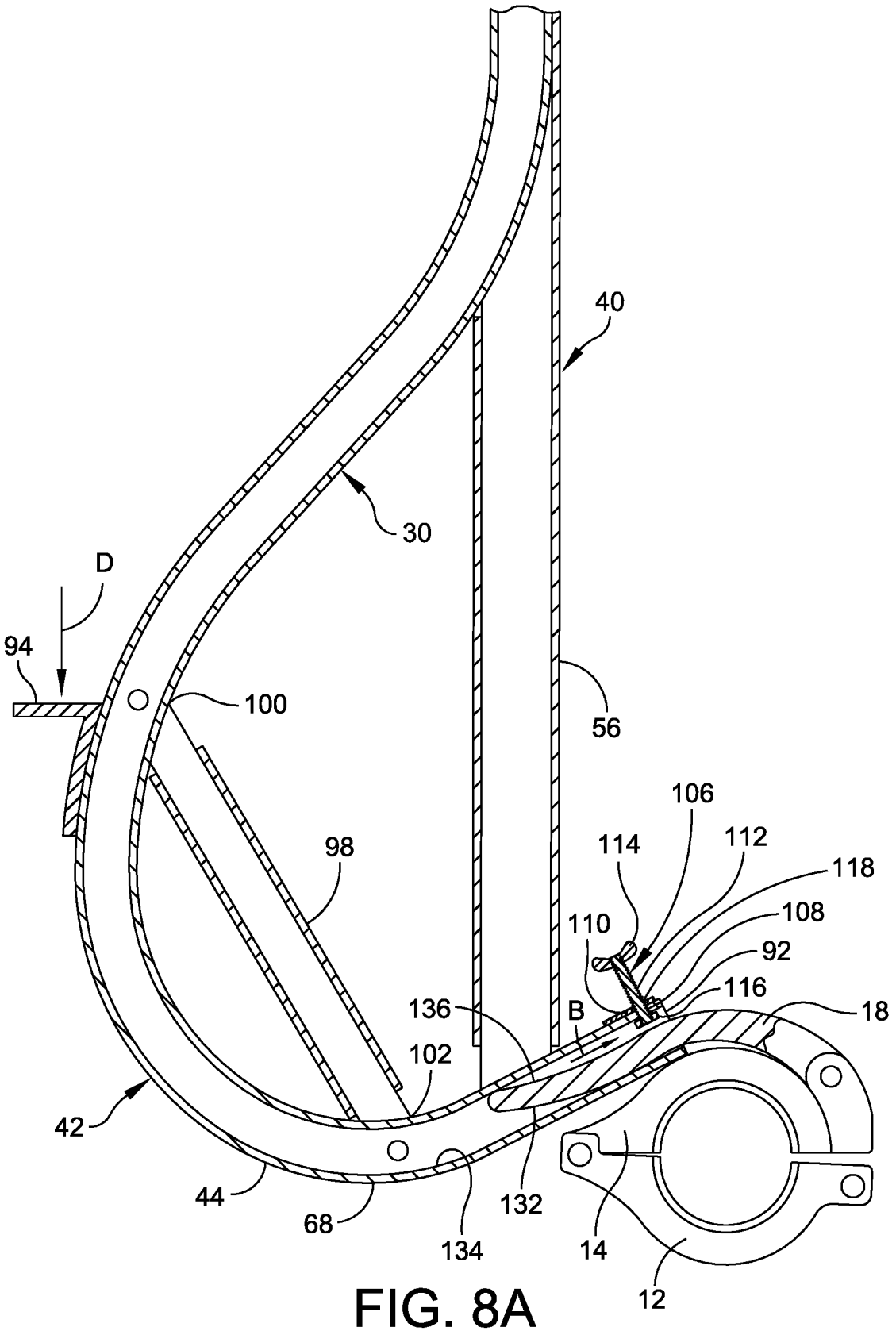
FIG. 8A is a cross-sectional view of the wrench operating the clamp.
Figure 8B:
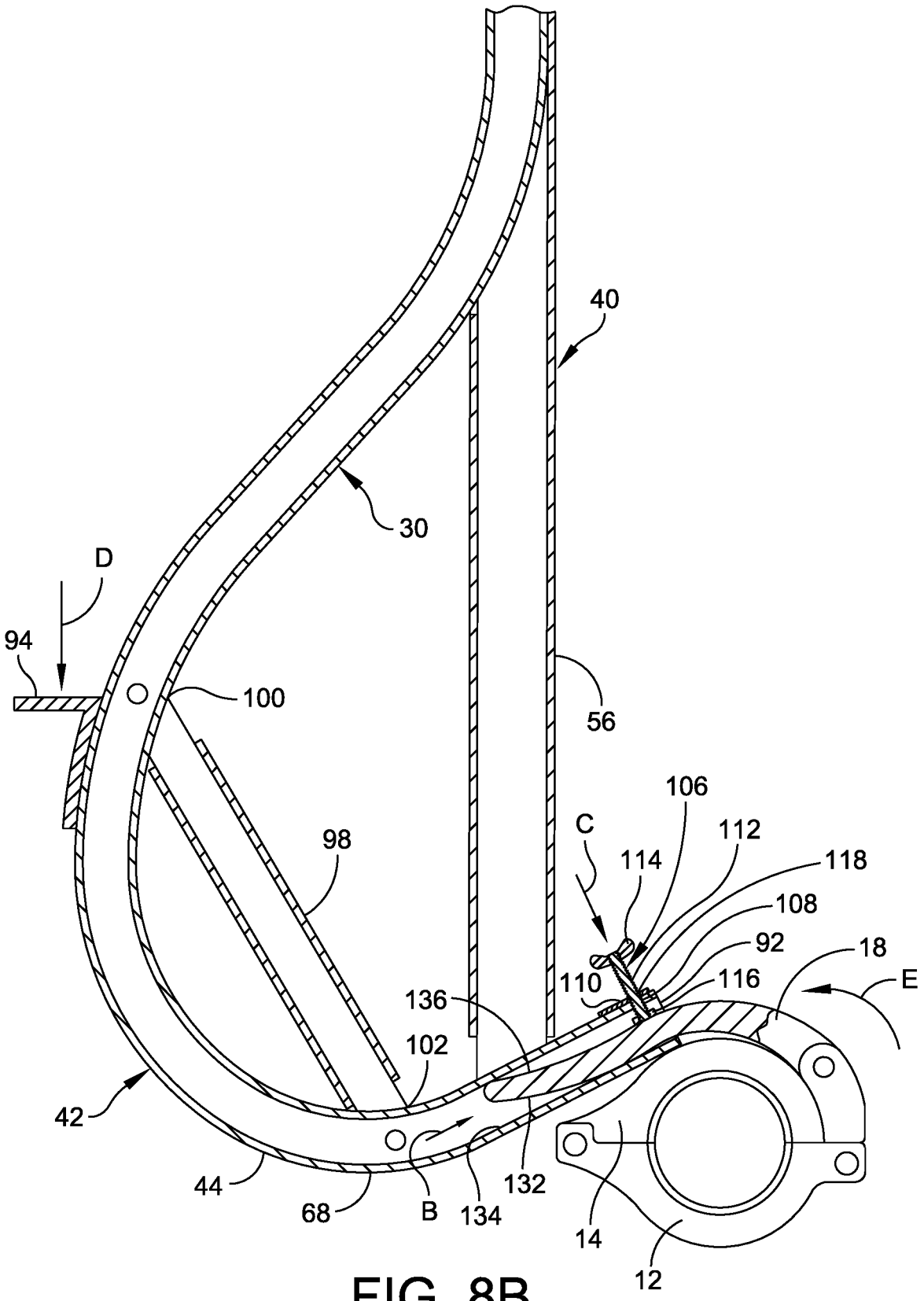
FIG. 8B is a cross-sectional view of the wrench operating the clamp.

Referring to FIGS. 8A and 8B, a person can use the wrench 30 to engage the lever 18 of the clamp 10 (FIG. 1) and open or close the clamp 10. The user moves the wrench 30 towards the lever 18 of the clamp so that the opening 92 of the tubular member 44 at the lower portion 68 of the tubular member 44 slides over the lever 18 along the direction of arrow B in FIG. 8A. In FIG. 8A, the lever 18 extends through the opening 92 and is received in the tubular member 44 of the second member 42.

The lever 18 is held in place within the tubular member 44 by a friction fit with the tubular member 44. Because of the curvature of the tubular member 44, the lever 18 is wedged within the tubular member 44, as shown in FIGS. 8A and 8B. A lower surface 132 of the lever 18 engages an engagement surface 134 and an upper surface 136 of the lever 18 engages the engagement surface 134. In some embodiments, the user then uses the wrench 30 as described below to rotate the lever 18 without using the locking means 106 to secure the lever 18 within the tubular member 44 of the wrench 30. In some embodiments, before using the wrench 30 to rotate the lever 18, the user adjusts the locking means 106 so that the position limiting nut 116 engages the lever 18. The user rotates the wingnut 114 so that the threaded bolt 112 advances downward along a direction shown by arrow C. Downward movement of the threaded bolt 112 along the direction of arrow C results in the position limiting nut 116 moving toward and engaging the lever 18 of the clamp 10. The user advances the threaded bolt 112 until the lever 18 is firmly secured between the position limiting nut 116 and the inner surface of the tubular member 44 of the second member 42. Once secured, the engagement surface 134 of the lower portion 68 of the tubular member 44 and the position limiting nut 116 engage the lever 18 of the clamp 10.

If a user wishes to rotate the lever 18 in a counterclockwise direction to close the clamshell portions 12, 14 of the clamp 10, the user may apply their weight to the platform 94 by placing one of their feet on the platform 94. The user shifts their weight onto the foot that is placed on the platform 94 and applies their weight to the platform along arrow D. Then the user pulls the handle to cause the wrench 30 to rotate in a counterclockwise direction. Counterclockwise rotation of the wrench 30 causes the lever 18 to rotate in a counterclockwise direction as shown by arrow E in FIG. 8B to close the clamp 10.

If a user wishes to rotate the lever 18 in a clockwise direction to open the clamshell portions 12, 14 of the clamp 10, the user may push the handle of the wrench 30 to cause the wrench 30 to rotate in a clockwise direction. Clockwise rotation of the wrench 30 causes the lever 18 to rotate in a clockwise direction, opposite to arrow E, to open the clamp 10.

The user then disengages the wrench 30 from the lever 18. For embodiments in which the user has adjusted the locking means so the position limiting nut 116 secures the lever 18 within the tubular member 44, the user then advances the bolt 112 in a direction opposite to the direction of arrow C until the position limiting nut 116 disengages the lever 18. The user overcomes the frictional fit of the lever 18 within the tubular member by sliding the tubular member 44 relative to the lever 18 in a direction opposite to arrow B in FIG. 8A

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A wrench for opening and closing a clamp having a lever, comprising:

a handle section;

a leverage section coupled to the handle section, the leverage section including an engagement surface to engage the clamp and an opening formed therein, the opening being configured to receive the lever of the clamp therein; and a locking assembly coupled to the leverage section, the locking assembly being configured to releasably secure the leverage section to the lever of the clamp when the lever is received within the opening of the leverage section;

wherein the handle section includes an upper portion and a lower portion, wherein the leverage section includes an upper portion secured to the upper portion of the handle section and a lower portion secured to the lower portion of the handle section, the lower portion of the leverage section having the opening that is configured to receive the lever of the clamp, wherein the handle section is substantially tubular and the leverage section is substantially tubular, wherein the upper portion of the leverage section is nested in the upper portion of the handle section, wherein the lower portion of the leverage section adjacent to the opening is curved, and wherein the locking assembly includes a threaded bolt that extends through a threaded hole in a wall of the leverage section so that an end of the threaded bolt is configured to secure the lever between the threaded bolt and an inner surface of the leverage section.

2. The wrench of claim 1, further comprising a strut having a first end and a second end each secured to the curved lower portion of the leverage section.

3. The wrench of claim 1, wherein the handle section is linear.

4. The wrench of claim 1, wherein the handle section and the leverage section are welded together.

5. The wrench of claim 1, further comprising two arms extending from the lower portion of the handle section, wherein the two arms are welded to the lower portion of the leverage section.

6. The wrench of claim 1, further comprising a platform extending laterally from an outer surface of the leverage section in a lateral direction away from the opening, for adding additional leverage.

* * * * *